US006705062B1

(12) United States Patent
Varlet

(10) Patent No.: US 6,705,062 B1
(45) Date of Patent: Mar. 16, 2004

(54) MACHINE FOR FILLING AND SEALING CONTAINERS

(75) Inventor: Jean-Pierre Varlet, La Neuville du Bosc (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/110,531

(22) PCT Filed: Oct. 12, 2000

(86) PCT No.: PCT/FR00/02844

§ 371 (c)(1),
(2), (4) Date: Aug. 9, 2002

(87) PCT Pub. No.: WO01/26970

PCT Pub. Date: Apr. 19, 2001

(30) Foreign Application Priority Data

Oct. 14, 1999 (FR) ..... 99 12800

(51) Int. Cl.[7] ..... B65B 31/00

(52) U.S. Cl. ..... 53/510; 53/253; 53/266.1; 53/276; 53/373.9

(58) Field of Search ..... 53/510–512, 253, 53/283, 284.7, 373.9, 267, 266.1, 276, 433, 432, 434

(56) References Cited

U.S. PATENT DOCUMENTS

| | | | | | |
|---|---|---|---|---|---|
| 3,670,786 | A | * | 6/1972 | Levin et al. | 141/92 |
| 3,745,741 | A | * | 7/1973 | Cunningham et al. | 53/88 |
| 3,899,862 | A | * | 8/1975 | Muys et al. | 53/426 |
| 3,953,272 | A | * | 4/1976 | Webber | 156/152 |
| 5,114,670 | A | * | 5/1992 | Duffey | 422/24 |
| 5,237,797 | A | * | 8/1993 | Varlet | 53/420 |
| 5,896,727 | A | * | 4/1999 | Egli et al. | 53/426 |
| 6,457,299 | B1 | * | 10/2002 | Schwenke et al. | 53/510 |

* cited by examiner

*Primary Examiner*—Stephen F. Gerrity
*Assistant Examiner*—Thanh Truong
(74) *Attorney, Agent, or Firm*—Sughrue Mion, PLLC

(57) ABSTRACT

A packaging machine for filling and sealing receptacles, the machine having a plurality of stations at which packaging operations are performed by packaging devices (21–29), the stations having at least a filling station (21) and a sealing station (23, 24, 27). The packaging machine includes a conveyor (10) for causing the receptacles to travel along a path passing through the various stations, the packaging machine being characterized in that the stations are disposed in an enclosure (2) in which a vacuum prevails.

12 Claims, 1 Drawing Sheet

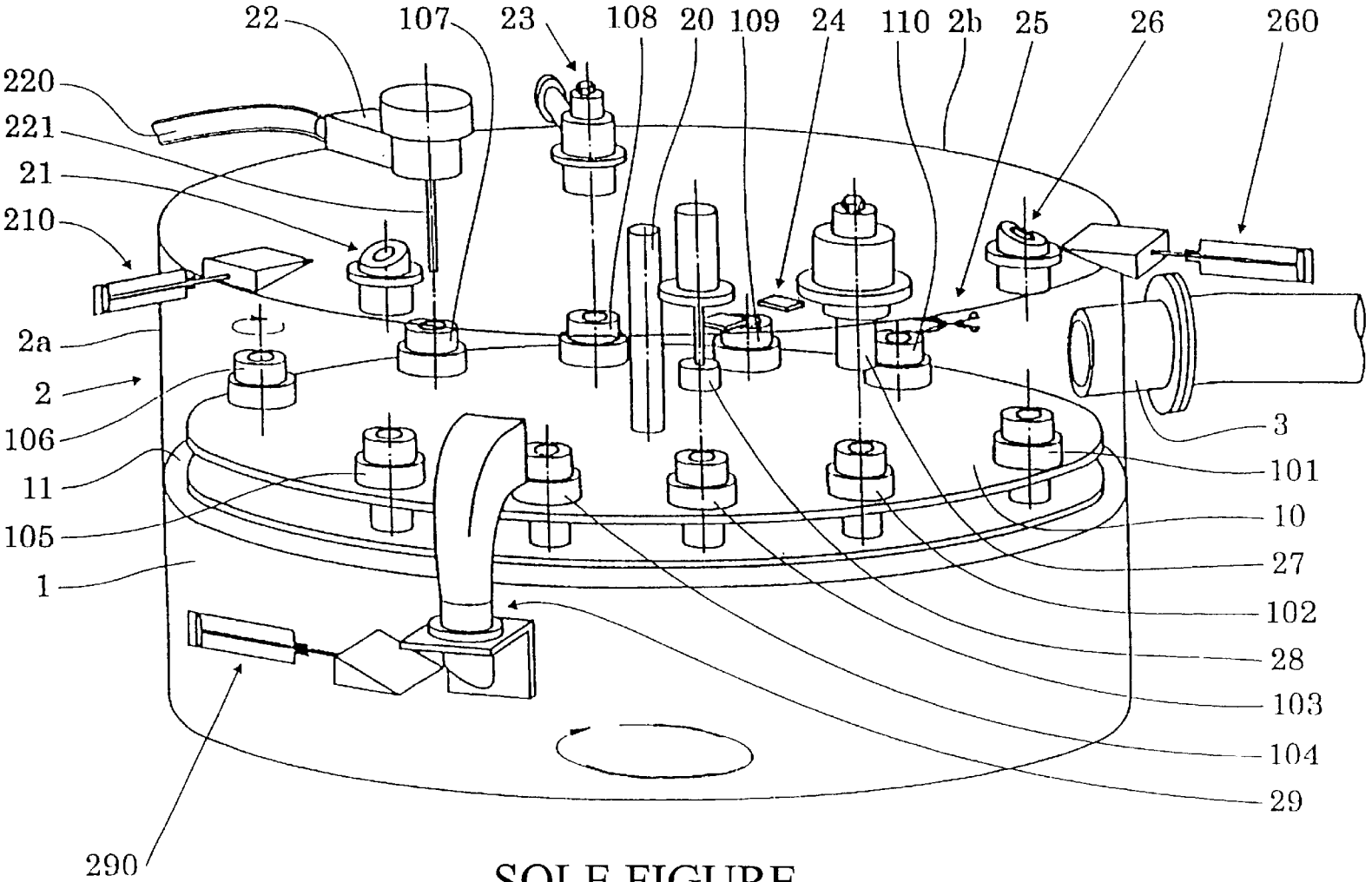
SOLE FIGURE

MACHINE FOR FILLING AND SEALING CONTAINERS

The present invention relates to a method and a machine for filling and sealing receptacles such as flexible tubes or rigid reservoirs equipped with fluid dispensers. The machine defined by the invention is thus applicable to the field of packaging fluids in general, and more particularly cosmetics or pharmaceuticals such as creams, lotions, or even more-watery liquids.

The industrial sectors of pharmaceuticals and of cosmetics, among others, produce many delicate fluids that require very good quality packaging. Certain fluids are sensitive or even reactive to air, to light, to humidity, etc. It is therefore necessary for the packaging of such fluids to protect them from such damaging environments.

A technique that is in wide use for fluids that are not too sensitive consists in providing the reservoir containing said fluid with an "airless" dispenser device, i.e. a dispenser device that has no air intake: as the fluid is dispensed, the volume of the reservoir decreases correspondingly so that the fluid is never in contact with air inside the reservoir. That type of dispenser device is in common use for fluids that tend to oxidize.

In the field of vacuum packaging, mention may be made of Document GB 246 347 which describes vacuum canning apparatus. That apparatus is provided with an inlet via which non-sealed filled cans are inserted. The cans follow a circular path on a rotary carrousel. Over a portion of the rotary path, the cans are subjected to a gradually increasing vacuum. The manner in which the vacuum sealed cans are removed from the carrousel to bring them back to ambient pressure is not described. The object of that apparatus is to seal cans under a vacuum without any sudden variation in pressure, which would disturb the contents of the still-open cans and thus cause said contents to be spilled. The problem of packaging delicate fluids is not addressed since the cans are filled at ambient pressure outside the apparatus.

Mention may also be made of Document U.S. Pat. No. 5,481,851 which describes apparatus for canning waste. In that apparatus, empty cans are inserted into a rotary carrousel via an inlet. The cans pass through various stations in which they are purged with nitrogen, they are filled with waste, they have their air evacuated from them, they are sealed, and then they are unloaded from the apparatus. Clearly, the cans are sealed in ambient air at the outlet door. The purpose of evacuating the air is not to achieve vacuum sealing, but rather merely to extract the air from the can.

For more sensitive fluids that are difficult to preserve, use is made of vacuum packaging techniques. The reservoir is sealed in an enclosure in which a certain degree of vacuum prevails. This guarantees that the fluid is not packaged in the reservoir together with air, which could damage it.

Document U.S. Pat. No. 3,006,120 describes apparatus for evacuating air from pouches, and for then filling them with gas and sealing them. Each pouch is brought into a rotary carrousel provided with sixteen enclosures, each of which serves to receive a respective pouch. Each enclosure comprises a cup and a lid to which an air evacuation line and a gas filling line are connected. Each lid is also provided with a sealing jaw system. There are therefore as many lines and as many sealing systems as there are enclosures, i.e. sixteen air evacuation lines, sixteen gas filling lines, and sixteen sealing systems. It is further necessary to break the vacuum in each enclosure for the purposes of removing the filled and sealed pouch, and of inserting a new pouch. That takes time. It should also be noted that the fluid packaged in the pouches, i.e. the gas, is not a delicate fluid, and the only object of removing the air is to improve the filling with gas, and not to keep the gas from the air. The filling gas occupies the entire volume of the enclosure so that there is definitely only gas in the pouch when it is sealed. That does not apply with liquids.

For very sensitive fluids, it is also necessary to incorporate preservatives in the fluid in order to improve stability because the fluid may be in contact with air before it is packaged. Adding preservatives has an impact on the cost of the fluid, and can, for some fluids, cause allergic reactions in the user.

An object of the present invention is to remedy the drawbacks of the prior art by defining a machine for packaging sensitive liquids that makes it possible to reduce, or even omit, preservatives. In addition, the machine should be capable of operating at high throughput. It should also be as compact as possible.

To this end, the present invention provides a packaging machine for filling and sealing receptacles, said machine having a plurality of stations at which packaging operations are performed by packaging means, the stations comprising at least a filling station and a sealing station, said machine including conveyor means for causing the receptacles to travel along a path passing through the various stations, the stations being disposed in an enclosure in which a vacuum prevails. By making provision for the filling and the sealing to be effected in a single common enclosure in which a vacuum prevails, it is possible to guarantee that the fluid to be packaged is never in contact with the air, so that it cannot be degraded. The fact that the fluid to be packaged is worked in a continuous vacuum makes it possible to reduce the quantity of preservatives required for its stability. Not only is the fluid less costly because of the small quantity of added preservatives, but also the fluid is purer. Another visible advantage procured by the invention lies in the fact that the throughput of the machine may be accelerated, since there is no longer any interruption of the vacuum during the filling and sealing step.

In addition, since the stations are placed in a common enclosure, all of the stations are common to all of the receptacles because they travel from one station to another. This does not apply in the device of Document U.S. Pat No. 3,006,120 in which each receptacle is placed in an individual enclosure equipped with packaging stations. Once the receptacle has been filled and sealed, the enclosure is opened. This does not apply in the invention, with a single enclosure housing all of the stations. The enclosure does not need to be opened under normal operating conditions.

According to technical characteristics of the invention, the conveyor means are in the form of a rotary carrousel equipped with a plurality of receptacle-receiving means for receiving the receptacles. The path described by the conveyor means thus forms a loop. In addition, the enclosure includes a vacuum bell which covers said plurality of stations in airtight manner. Advantageously, the packaging means are secured to the vacuum bell. In addition, the bell is provided with an insertion airlock for inserting empty receptacles, and with an ejection airlock for ejecting filled and sealed receptacles.

In one embodiment, the packaging means include hot air sealing means serving to seal flexible receptacles. This technique of sealing by heating with air is a known technique in packaging fluids in flexible casings or tubes. However, a paradoxical characteristic of the present invention lies in the fact that such a technique is used in a vacuum enclosure. Whereas other known techniques such as sealing by ultrasound, induction, or heater jaws are more easily imaginable in an enclosure in which a vacuum prevails, because they do not use air, the technique used in the invention goes against the requirements of vacuum sealing because hot air is forced into the enclosure, which would normally break or weaken the vacuum.

The technique of heating by air is advantageous compared with the above-mentioned techniques because the mechanism is simpler and makes it possible to heat only the inside wall of the flexible receptacle. In addition, it makes it possible to obtain higher throughputs. With heater jaws, it is necessary to have three of four pairs of jaws to obtain the same throughput.

Alternatively or additionally, the packaging means include crimping means for crimping a dispenser device to the neck of a reservoir. Also alternatively or additionally, the packaging means include snap-fastening means for snap-fastening a dispenser device to the neck of a receptacle. Advantageously, the vacuum bell is provided with an insertion airlock for inserting dispenser devices. The machine of the invention may comprise a plurality of stations specifically adapted to packaging a plurality of different types of receptacle. To this end, the receptacle-receiving means may be modulated or interchanged as a function of the type of receptacle to be received.

The invention is described more fully below with reference to the accompanying drawing which gives an embodiment of the invention by way of non-limiting example.

In the drawing, the sole FIGURE shows a multi-purpose packaging machine of the present invention.

The example of the machine chosen to illustrate the present invention is of the multi-purpose type, i.e. it is adapted to packaging both flexible tubes and rigid reservoirs. Conventionally, each flexible tube is filled via one of its ends which is left open to enable filling to take place. Once the fluid has been inserted into the flexible tube, the end of the tube is sealed in leaktight manner. This operation of sealing the end of the tube is generally achieved by heat-sealing. That is why the flexible tubes must be made of a material capable of softening at a relatively low temperature. In general, the flexible tubes are made of a plastics material. The rigid reservoirs are generally made of glass or of metal, and the filling operation takes place via the neck of the reservoir. The operation of sealing the reservoir is achieved by fixing the chosen dispenser device to it. There are various methods of fixing a dispenser device to the neck of a rigid reservoir. For example, the dispenser device may be crimped or snap-fastened in leaktight manner. The machine shown in the sole FIGURE is thus of a multi-purpose type because it is capable of handling both of these types of packaging. Naturally, and without going beyond the ambit of the invention, it is possible to imagine a machine capable of handling one of the types of packaging only, i.e. either flexible tubes or rigid receptacles.

The machine proposed by the present invention makes it possible to package a liquid-to-creamy fluid, and preferably a creamy fluid, in the above-described types of packaging, from filling to sealing. According to a very advantageous characteristic of the invention, the packaging steps from filling to sealing take place in an environment in which a vacuum prevails. Therefore, the fluid being packaged never comes into contact with air. In order to keep the fluid isolated from air, it is necessary to provide the packaging, i.e. the flexible tubes and/or the flexible receptacles, with airless dispenser devices. It is thus guaranteed that the fluid is never in contact with air until it is dispensed by the user.

With reference to the sole FIGURE, it can be seen that the multi-purpose packaging machine in the embodiment shown is cylindrical in overall shape and is made up essentially of two portions, namely a bottom portion forming a base 1 and a top portion formed by a transparent bell 2.

The base 1 includes a cylindrical protective outer shell enclosing a motor suitable for generating turning about an axis 20 passing centrally through the base and the transparent bell 2. The motor enclosed in the base 1 is also provided with indexing means that make it possible to stop the turning motion generated by the motor in predetermined locations. A turntable 10 is mounted to turn about the axis 20. The turntable is of annular shape and of size substantially corresponding to the size of the protective shell of the base 1. Naturally, the axis of rotation 20 passes through the center of the turntable 10, so that said turntable is caused to turn about its own axis under drive from the motor. Because of the indexing associated with the motor, the turntable 10 is caused to stop after turning through a certain determined angle. The turntable 10 is provided with a plurality of means, in the form of cups, for receiving flexible tubes or rigid reservoirs. In the embodiment shown in the sole FIGURE, ten cups are provided, designated by the numerical references 101 to 110. Since there are ten cups provided in the example shown, the indexing associated with the motor must be suitable for stopping the turning motion after an angular stroke of 36°. The turntable 10 thus forms an indexed carrousel provided with a plurality of cups for receiving containers (flexible tubes or rigid receptacles). Each cup 101 to 110 is actuated by a raising and lowering actuator (not shown) situated below the turntable 10 in the base 1. Under the action of its respective actuator, each cup is thus capable of moving in vertical translation.

The indexed carrousel formed by the turntable 10 is merely an embodiment of conveyor means suitable for causing the containers to travel. Naturally, it is possible to devise other versions for the conveyor means, e.g. for conveying the containers along rectilinear conveyor paths. A circular conveyor path as used in the present description is merely a preferred embodiment of the conveyor means necessary for the present invention. All of the cups can be moved by a single motor and by single indexing means.

The base 1 comprises the motor and its turntable 10 equipped with its cups and underlying the cylindrical transparent bell 2 which stands in airtight manner on a peripheral edge 11 of the base 1 so that the base and the bell together form a vacuum enclosure. For example, a sealing gasket may be interposed between the transparent bell 2 and the base 1. The transparent bell 2 has a cylindrical peripheral wall 2*a* and an annular cover 2*b*.

The vacuum inside the enclosure is achieved by evacuating the air through an evacuation channel 3 connecting the bell 2 to a vacuum pump capable of extracting up to 2000 cubic meters ($m^3$) of air per hour. The air pump must also be capable of evacuating an incoming air flow of a few cubic meters per hour while maintaining a pressure approximately in the range a few millibars to a few tens of millibars inside the enclosure, for reasons given below. The working pressure of the packaging machine of the invention thus lies in the pressure range a few millibars to a few tens of millibars, and is preferably ten millibars. At this pressure, it can be considered that the fluid is not in contact with air.

The indexing of the carrousel 10 is suitable for stopping the turntable from turning so that the cups 101 to 110 remain stationary for a relatively short lapse of time at positions in which they co-operate with respective associated packaging devices or instruments to define a plurality of packaging stations. A cup considered individually, e.g. the cup referenced 101, thus travels over a circular path and stops at each packaging station. The angular offsets between the various cups 101 to 110 must be strictly equal since each cup must go through all of the packaging stations.

The packaging instruments, units or devices provided at each packaging station are mounted on the transparent bell 2, either on its peripheral wall 2*a*, or on its cover 2*b*. Other packaging instruments, units or devices are directly included in the transparent bell 2. The devices provided on the transparent bell 2 are those which serve to insert something into the bell or to extract something therefrom. The other packaging devices provided in the bell are those serving to act directly on the receptacle.

In the order of the packaging sequence, the first packaging device is the insertion airlock 21 which serves to insert the empty receptacles into the transparent bell 2. The airlock 21 is shown diagrammatically with its vacuum door 210 which closes off the passageway of the receptacle. The empty receptacles thus penetrate into the bell through this airlock 21, and they are positioned in the successive cups situated exactly vertically below the insertion airlock 21. This is how the receptacles are inserted into the transparent bell 2.

As indicated by the circular arrow shown on the base 1, the turntable 10 turns clockwise. Thus, the next packaging station corresponds to the packaging station in which the cup referenced 106 is positioned. This packaging station does not need any device fixed on the transparent bell 2. It is the packaging station serving to set the angular positions of the receptacles as still empty. This angular positioning of the receptacles takes place simply by turning the cup. Once the receptacle is correctly angularly positioned, the turntable moves once again through one tenth of a turn to the next packaging station.

This station includes a filling unit 22 which feeds the fluid from a feed pipe 220. It should be noted that the filling unit is mainly situated outside the transparent bell 2 on its cover 2*b*. Only the filling tube 221 which penetrates into the receptacle for filling it with fluid is disposed inside the transparent bell 2. Thus, it is not necessary to remove the transparent bell from its base 1 to act on the mechanism of the filling unit 22. The filling unit 22 may be equipped with a device for monitoring the fluid level and enabling the filling tube 221 to rise as the receptacle fills with fluid. Once the receptacle is filled with a sufficient quantity of fluid, the indexed motor of the turntable 10 is activated to bring the cup to the following station.

In the multi-purpose machine used to explain the invention, it is possible to package both flexible tubes and rigid receptacles. To this end, the following three packaging stations serve specifically for flexible tubes. Prior to being inserted through the insertion airlock 21, the flexible tubes are already equipped with dispenser devices such as pumps. The end of the flexible tube that is situated at the end opposite from the pump is still open because it is through this open end that the fluid is inserted. The flexible tubes with their pumps and their open ends are inserted through the insertion airlock 21 while they are upside down, so that the pump is disposed in the cup. The flexible tubes are then conveyed to the filling unit 22 where they are filled. The next three stations, which are described in detail below, serve to seal the end of the flexible tube. The first of these packaging stations, corresponding to the position of the cup 108, is a heater unit 23 which serves to heat the open end of the flexible tube in order to soften it for the purpose of subjecting it to heat-sealing. Thus, once the filled flexible tube comes vertically in register with the heater unit 23, the actuator of the cup is actuated to cause the flexible tube to rise until its open end is engaged over the heater nozzle of the heater unit. In the invention, the heater unit 23 is a hot air heater unit suitable for forcing hot air onto the end of the tube so as to soften it. Paradoxically, air is inserted through the heater unit into the enclosure in which a vacuum prevails. That is why the vacuum pump connected via the vacuum channel 3 must be capable of evacuating an incoming air flow of a few cubic meters per hour. The incoming air flow delivered through the heater unit is about a few cubic meters per hour at a temperature in the range 270° C. to 300° C. The heater nozzle is fed with filtered ambient air. This means that if the feed air and the air around the machine is sterile or clean, the probability of having a clean vacuum enclosure is higher. The sealing technique used in the multi-purpose machine of the invention, namely air heating, is a technique that is known in packaging fluids in flexible tubes or casings. However, while other known techniques such as sealing by induction, by ultrasound, or by heater jaws are more easy to imagine in an enclosure in which a vacuum prevails, because they do not use air, the technique used in the invention goes against the requirements of vacuum sealing, given that the hot air is forced into the enclosure, which would normally break or weaken the vacuum. The technique of heating with air is advantageous compared with the above-mentioned techniques because the mechanism is even simpler and makes it possible to heat only the inside wall of the end of the tube. In addition, it makes it possible to obtain higher throughput. With heater jaws, it is necessary to have three or four pairs of jaws in order to obtain the same throughput. The hot air is fed at a flow rate approximately in the range 1 $m^3$ per hour to 12 $m^3$ per hour, and preferably 7 $m^3$ per hour. Once the top end of the end portion of the flexible tube is sufficiently softened, which takes a few tenths of a second, the flexible tube is displaced to the next packaging station which is equipped with cold sealing jaws 24 suitable for being pressed together with the heated open end nipped between them. This results in the heated open end of the tube being applied onto itself so as to achieve heat-sealing. It is therefore essential for the step of pressing the open end onto itself to be performed a very short time after the end has been heated at the heater unit 23. Preferably, to prevent the temperature of the jaws from rising excessively, and to enable the sealing to take place as quickly as possible, an internal water cooling circuit is provided for cooling them. As soon as the end of the flexible tube has been pressed by the cold jaws 24, the flexible tube is sealed.

It is also possible to imagine that the machine can seal flexible receptacles of types other than flexible tubes, such as flexible pouches, flexible casings, etc. This hot air vacuum sealing technique may be used to seal all types of flexible receptacles, and it can be implemented independently of a rotary carrousel.

The next packaging station corresponding to the cup 110 is equipped with a cutting device 25 serving to cut off the tip of the end portion of the flexible tube that is situated beyond the heat seal, for reasons of pleasing appearance. The offcuts of plastic may be ejected from the enclosure via a volume airlock.

The flexible tube as filled and sealed is then conveyed to its next packaging station at which it is extracted from the enclosure via an ejection airlock 29. From the station equipped with the cutting device 25 to the ejection airlock 29, the flexible tube is not subjected to any further packaging operation, although it stops at and goes on from three stations corresponding to the positions of the cups 101, 102, and 103. The ejection airlock 29 may be an airlock mounted to move in reciprocating manner and equipped with a vacuum door 290.

In the invention, the multi-purpose machine is also adapted to packaging rigid receptacles on which dispenser devices such as pumps may be mounted. The rigid receptacles, which may be made of glass, of metal, or of plastic, are inserted through the insertion airlock 21 while they are not yet equipped with their pumps. They are positioned in the cups with their mouths open upwards. They undergo the same packaging operations as the above-mentioned flexible tubes until the filling unit 22. They are thus angularly positioned and then filled with the desired fluid. Then, the filled rigid receptacle does not undergo any packaging operation at the next three stations corresponding to the hot sealing for flexible tubes. The next station at which the rigid receptacle undergoes a packaging operation corresponds to the position of the cup 101. In this position, the cup is vertically in register with a pump insertion airlock 26 equipped with a vacuum door 260. The pumps are thus inserted at this airlock 26 and they are positioned on the necks of the filled rigid receptacles.

The filled rigid receptacle then moves on to the next station corresponding to the position of the cup 102. The cup is then situated vertically in register with a crimping or snap-fastening unit 27. As a function of the technique used to fix the pump on the neck of the receptacle, either a crimping unit or a snap-fastening unit may be provided. Regardless of whether the pump is fixed to the neck of the receptacle by snap-fastening or by crimping, the effect of this fixing is to isolate the fluid inside the receptacle in airtight manner. Whereafter, the fluid contained in the receptacle no longer has any contact with air until it is dispensed. Advantageously, the crimping height and diameter may be set from the outside without stopping the machine.

The next station is equipped with an injection unit for injecting nitrogen or filtered air into the metering chamber of the pump so as to prevent any fluid from being dispensed while the pusher is being fitted to the pump. A full and detailed description of the structures and modes of operation of the crimping or snap-fastening unit and of the gas injection unit is given in Document EP-0 509 179.

Once it has left the last packaging station 28, the filled receptacle as equipped with its pump fixed in airtight manner is ejected from the enclosure via the ejection airlock 29, which also serves for ejecting the flexible tubes. To this end, it should be noted that the airlock systems, which are preferably reciprocating systems, make it possible to take the containers and the pumps from atmospheric pressure to a pressure of about 10 millibars without any difficulty and without affecting the vacuum.

The multi-purpose machine of the invention makes it possible firstly to handle a plurality of different types of receptacle (flexible tubes or rigid receptacles), and secondly to perform filling and sealing operations under a continuous vacuum. This makes it possible to achieve high throughput, since it is not necessary to return to atmospheric pressure between each operation. All of the operations follow without interruption in a controlled vacuum atmosphere.

It should also be noted that the units required for inserting or ejecting the receptacles, and the units required for filling, heating, crimping or snap-fastening, and injecting gas are mainly situated outside the enclosure. Thus, it is possible to act on their mechanisms without having to remove the transparent bell 2. These units can even be adjusted while the multipurpose machine is operating.

The multi-purpose machine chosen to illustrate the invention constitutes merely one embodiment of the invention. It is possible to consider a multi-purpose machine that has more or less packaging stations, but in which all of the stations work in an enclosure in which a continuous vacuum prevails.

What is claimed is:

1. A packaging machine for filling and sealing receptacles, said machine having a plurality of stations at which packaging operations are performed by packaging means (21–29), the stations compromising at least filling station (21) and a sealing station (23, 24, 27), said machine including conveyor means (10) for causing the receptacles to travel along a path passing through the various stations said packaging machine being characterized in that the stations are disposed in an enclosure (2) in which an air vacuum is maintained.

2. A machine according to claim 1, in which the conveyor means (10) are disposed inside the enclosure (2), and they are in the form of a rotary carrousel equipped with a plurality of receptacle-receiving means (101–110) for receiving the receptacles.

3. A machine according to claim 2, in which the receptacle-receiving means (101–110) may be modulated or interchanged as a function of the type of receptacle to be received.

4. A machine according to claim 1, in which the enclosure includes a vacuum bell (2) which covers said plurality of stations.

5. A machine according to claim 4, in which the packaging means (21–29) are secured to the vacuum bell (2).

6. A packaging machine according to claim 4, in which the bell (2) is provided with an insertion airlock (24) for inserting empty receptacles, and with an ejection airlock (29) for ejecting filled and sealed receptacles.

7. A machine according to claim 1, in which the packaging means include hot air sealing means (23) serving to seal flexible receptacles.

8. A packaging machine according to claim 1, in which the packaging means include crimping means (27) for crimping a dispenser device to the neck of a reservoir.

9. A machine according to claim 8, in which the enclosure vacuum bell is provided with an insertion airlock (26) for inserting dispenser devices.

10. A machine according to claim 1, in which the packaging means include snap-fastening means (27) for snap-fastening a dispenser device to the neck of a receptacle.

11. The machine according to claim 1, in which the pressure inside the enclosure when the vacuum is maintained is about a few millibars to a few tens of millibars.

12. The machine according to claim 1, in which a pharmaceutical or cosmetic is filled in the receptacles.

* * * * *